US007797887B2

(12) United States Patent
Maupas

(10) Patent No.: US 7,797,887 B2
(45) Date of Patent: Sep. 21, 2010

(54) SYSTEM FOR MAKING A LIQUID-RETAINING WALL, SUCH AS A SWIMMING POOL WALL, OUT OF PREFABRICATED PANELS

(75) Inventor: Alain Maupas, Locmariaquer (FR)

(73) Assignee: Diffusion Equipments Loisirs, Brece (FR)

( * ) Notice: Subject to any disclaimer, the term of this patent is extended or adjusted under 35 U.S.C. 154(b) by 1150 days.

(21) Appl. No.: 10/700,455

(22) Filed: Nov. 5, 2003

(65) Prior Publication Data

US 2004/0134145 A1 Jul. 15, 2004

(30) Foreign Application Priority Data

Nov. 8, 2002 (FR) ..... 02 14076

(51) Int. Cl.
*E02D 27/00* (2006.01)

(52) U.S. Cl. ..... 52/169.7; 52/247; 52/716.2; 4/506

(58) Field of Classification Search ..... 52/102, 52/166, 169.7, 169.9, 245, 247, 250, 281, 52/293, 588.1, 585.1, 2, 261, 716.2, 293.1; 403/286, 291, 293; 4/488, 506, 513
See application file for complete search history.

(56) References Cited

U.S. PATENT DOCUMENTS 2,446,323 A * 8/1948 Davis et al. ..... 52/394
3,268,917 A * 8/1966 Diemond et. al. ..... 52/245
3,280,408 A * 10/1966 Gershman ..... 52/245
3,440,780 A * 4/1969 West et al. ..... 52/169.7
3,736,599 A * 6/1973 Kessler et al. ..... 52/169.7
3,793,651 A * 2/1974 Pitti et al. ..... 52/169.7
3,986,310 A 10/1976 Van Den Broek
4,464,802 A * 8/1984 Glonek et al. ..... 4/506
4,974,266 A 12/1990 Vultaggio et al.
5,155,872 A 10/1992 Aymes
5,896,715 A * 4/1999 Maupas ..... 52/465

* cited by examiner

*Primary Examiner*—Richard E Chilcot, Jr.
*Assistant Examiner*—William V Gilbert
(74) *Attorney, Agent, or Firm*—Clark & Brody

(57) ABSTRACT

A system for making a liquid-retaining wall, and such a wall, such as a swimming pool wall, from prefabricated plane panels, the system comprising assembly means for assembling together two consecutive vertically-disposed panels, a low belt which supports the panels, and a high belt which is fitted to the panels, the assembly means holding together two assembled-together panels while allowing one of the panels to move angularly relative to the other about a vertical axis, and also including angle-determining means for ensuring that at least two consecutive panels are at a determined angular orientation relative to each other, and further including stiffening means for stiffening the assembled panels wherein each angle-determining means is constituted by a part presenting two arms that form a determined angle relative to each other.

21 Claims, 6 Drawing Sheets

SYSTEM FOR MAKING A LIQUID-RETAINING WALL, SUCH AS A SWIMMING POOL WALL, OUT OF PREFABRICATED PANELS

The invention relates to a system for making a liquid-retaining wall, such as a swimming pool wall, out of prefabricated panels, and it also relates to a swimming pool made with such a system.

BACKGROUND OF THE INVENTION

Document EP-0 799 952 discloses a system of assembling prefabricated panels, in particular to make a swimming pool wall, the system for assembling together two consecutive panels being provided by a rigid internal section member which is mounted between two adjacent flanges of two consecutive panels, and a rigid or semi-rigid external section member which covers the two flanges, the external section member generally being mounted first while the internal section member is subsequently engaged by force or with little clearance.

OBJECT AND SUMMARY OF THE INVENTION

The object of the invention is to improve the assembly system as described in the above-specified documents so as to make it possible in particular to make a water-retaining wall from prefabricated panels of a single type and regardless of the rectilinear and/or curved shape of the outline of the wall.

To this end, the invention provides a system for making a liquid-retaining wall, such as a swimming pool wall, from prefabricated panels, the system comprising at least assembly means for assembling together two consecutive vertically-disposed panels, a low belt which supports the panels, and a high belt which is fitted to the panels, the assembly means having the function of holding together two assembled-together panels while allowing one of the panels to move angularly relative to the other about a vertical axis, and also including angle-determining means for ensuring that at least two consecutive panels are at a determined angular orientation relative to each other as a function of the outline of the wall to be made, and further including reinforcing means for stiffening the panels once they have been assembled to one another.

According to the invention, the system is remarkable in that the wall is made up of plane panels which are equally suitable for being included in a rectilinear or in a curved portion of the outline of the wall to be made, and in that each angle-determining means is constituted by a part presenting two arms that form a determined angle relative to each other. There is no need to make use of curved panels in a curved portion.

In an embodiment, all of the panels of the wall are identical.

In general, the low belt, which supports the panels, is constituted by a set of channel section members forming gutters, each section member extending over a length of not less than the length of one panel, and the high belt, which is fitted onto the panels, is constituted by a set of strips associated with a set of channel section members forming gutters, each strip and the associated channel section member extending over a length that is not less than the length of a panel, the low and high belts being interconnected by the section members of the assembly means.

The means for determining angles between two consecutive panels are received in the low belt and/or the high belt, in particular in the gutters of the section members.

Furthermore, means are provided for leveling the heights of the panels, and means are provided for stiffening the low and high belts in order to "freeze" the outline of the wall once the panels have been assembled together.

According to an important advantage of the invention, it is possible to make swimming pool walls of arbitrary outline with panels that can all be of the same type, thereby considerably simplifying problems of panel manufacture, maintenance, and storage.

Furthermore, the small dimensions of the panels make them easier to handle and to transport.

By way of example, each panel is substantially rectilinear in shape, extending over a height of about 1.10 meters (m) and over a length of about 50 centimeters (cm), each panel being made from a piece of sheet metal having thickness of the order of 1.5 millimeters (mm) to 2 mm, which is advantageous from the point of view of manufacturing cost.

BRIEF DESCRIPTION OF THE DRAWINGS

Other advantages, characteristics, and details of the invention appear from the additional description below made with reference to the accompanying drawings which are given purely by way of example and in which.

MORE DETAILED DESCRIPTION

Figure 1:
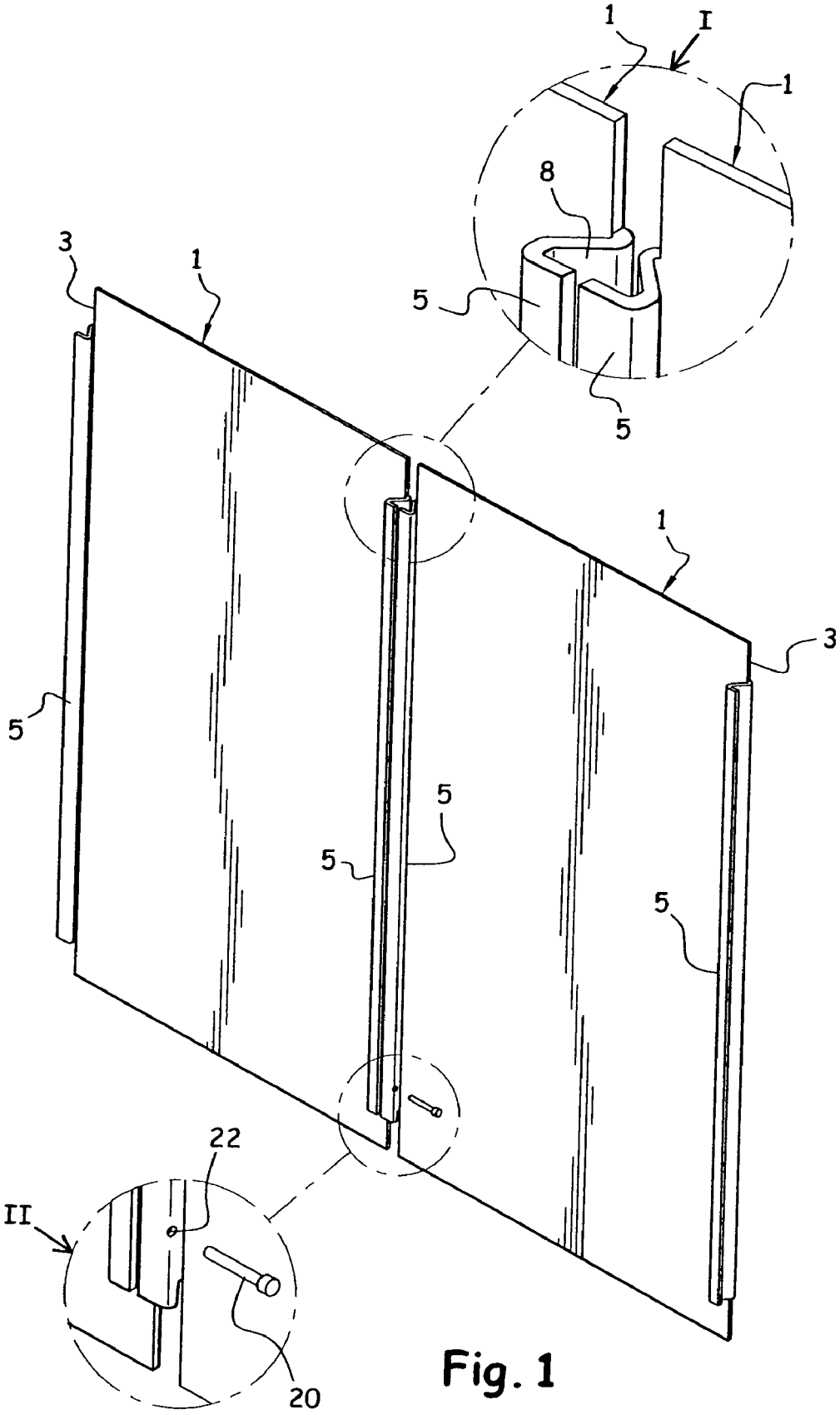
FIG. 1 is a perspective view showing two consecutive panels of a swimming pool wall prior to being assembled together, and also showing two details I and II.

The present invention provides a system for making a wall water-retaining wall, e.g. a swimming pool wall having a closed outline, by using prefabricated panels 1 such as those shown in FIG. 1. Each panel is plane and presents a rectangular shape having two lateral edges 3 which define the height of the panel 1. Each panel 1 is machined in such a manner as to present a folded flange 5 along each of its lateral edges 3, the two flanges 5 being folded towards the same side of the panel 1. In the example shown in FIG. 1, the two flanges 5 of each panel 1 extend over a fraction only of the height of the panel 1. The flanges 5 of each panel 1 are shaped so that the two adjacent flanges 5 of two consecutive panels 1 define between them a vertical groove or slot 8 of substantially constant right section, as can be seen from detail I of FIG. 1.

Two consecutive panels 1 are connected together by assembly means 10 suitable for co-operating with the two adjacent flanges 5 of two consecutive panels 1. In the embodiment shown in FIG. 2, the assembly means 10 comprise two rigid or semi-rigid sections members, respectively an internal member 12 and an external member 14.

Figure 3:
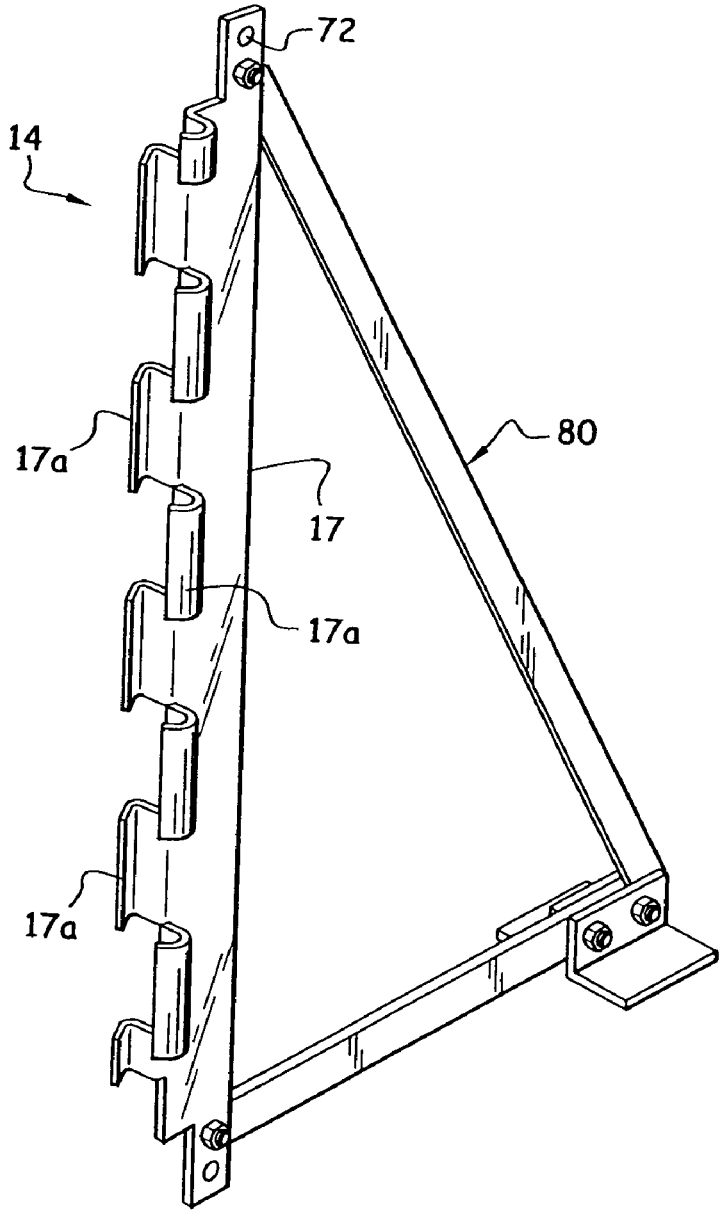
FIG. 3 is a perspective view of one of the assembly means shown in FIG. 2.

The internal, first section member 12 is in the form of a rod and is received inside the slot 8, being inserted freely through one of the end of the slot 8. The second section member 14 is fitted so as to be placed over the two adjacent flanges 5 of two consecutive panels 1. In an embodiment shown in FIG. 3, the second section member 14 is a single part in the form of a rectangular plate 17 having a longitudinal edge with alternating flange segments 17*a* which extend over a fraction of the height of the plate 17 to define a discontinuous slot 18 suitable for encompassing the two adjacent flanges 5 of two consecutive panels 1. The second section member 14 is put into place vertically along the flanges 5. The order in which the two section members 12 and 14 of the assembly means 10 are put into place does not matter.

Figure 2:
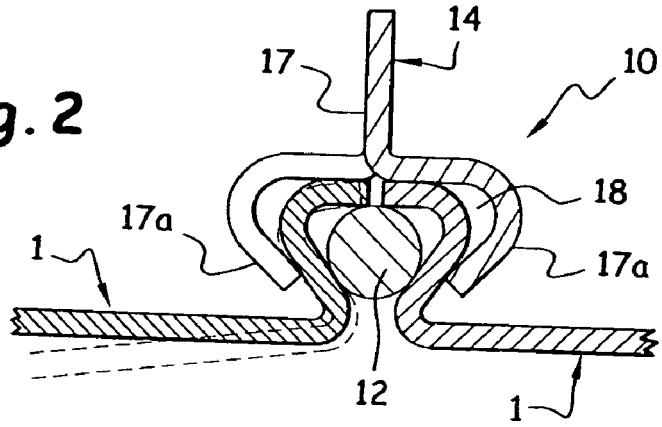
FIG. 2 is a section view to show the means for assembling together the two panels shown in FIG. 1.

Once the assembly means have been fitted to two consecutive panels 1, one panel is free to move angularly relative to the other about a vertical axis occupied by the rod-forming first section member 12 of the assembly means 10, as represented diagrammatically by dashed lines in FIG. 2. An angular offset is formed between at least two consecutive panels 1 whenever it is desired to make a curved portion of the wall.

With reference again to FIG. 1, and in particular to its detail II, means 20, in the form of a pin in the example shown, are engaged between the two adjacent flanges 5 of two consecutive panels 1 in order to put the panels 1 at the same level. By way of example, the pin is passed through two holes 22 formed in the flanges 5 of the panels 1. These holes 22 are situated, for example, near the bottoms of the flanges 5 so as to avoid interfering with inserting the first section member 12 of the assembly means 10.

The system for making the swimming pool wall also comprises a low belt 25 on which the panels 1 rest, and a high belt 27 which is fitted to the panels 1.

Figure 4:
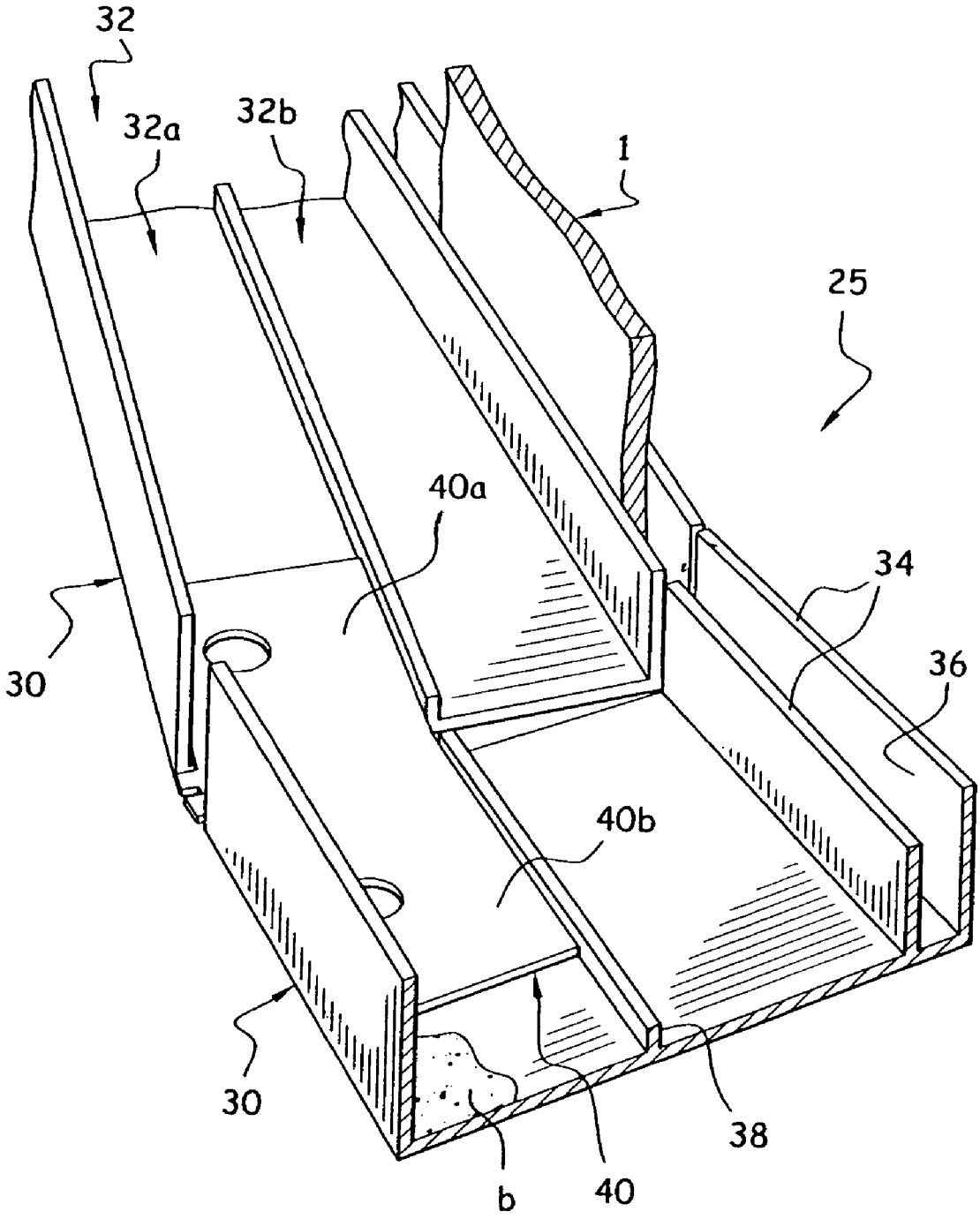
FIG. 4 is a fragmentary perspective view to show the low belt of the wall serving to support the panels.

As shown in part in FIG. 4, the low belt 25 is constituted by a set of rectilinear channel section members 30 each forming a gutter 32. One edge of each section member 30 presents a double wall 34 defining a slot 36 in which the bottom portion of at least one panel 1 is received. Each section member 30 extends over a length that is not less than the length of a panel 1 supported thereby. In its central portion, each section member 30 presents a rib 38 which subdivides the gutter 32 into two portions 32*a* and 32*b*. The portion 32*a* of the gutter 32 which is remote from the panels 1 serves to receive angle-determining means 40 for determining an angle between two successive panels 1. Each angle-determining means 40 is a plane part comprising two arms 40*a* and 40*b* that form a certain angle between each other so as to orient two successive panels 1 relative to each other at the desired angle, the two arms 40*a* and 40*b* being received respectively in two adjacent gutters 32 of two consecutive panels 1.

Figure 5:
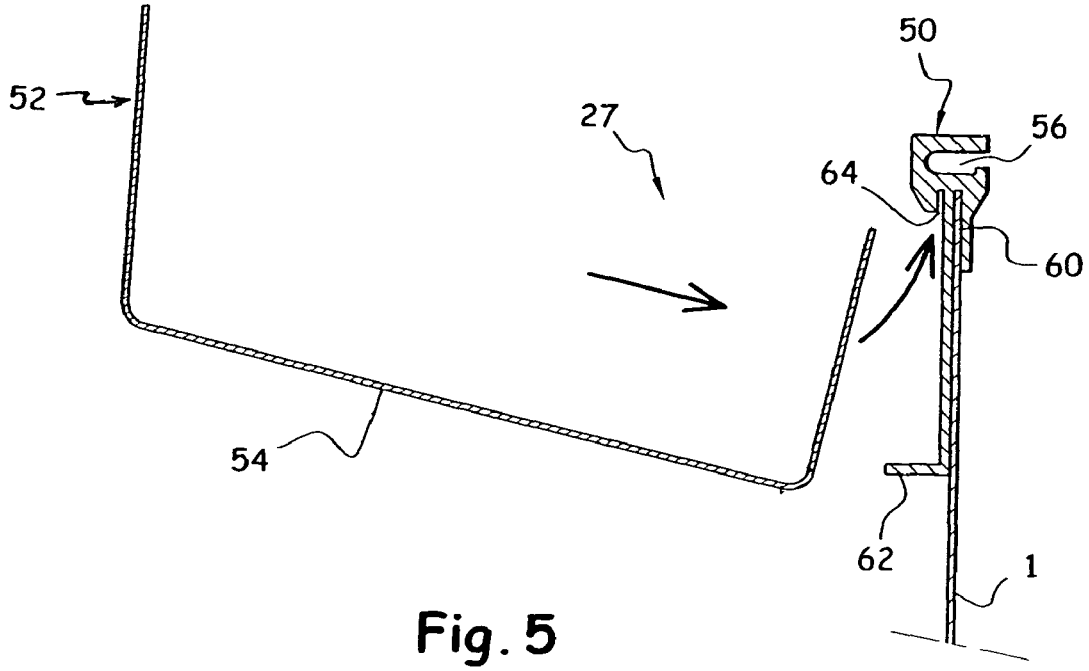
FIGS. 5 and 6 are diagrammatic section views showing the high belt of the wall which is fitted to the panels.
Figure 6:
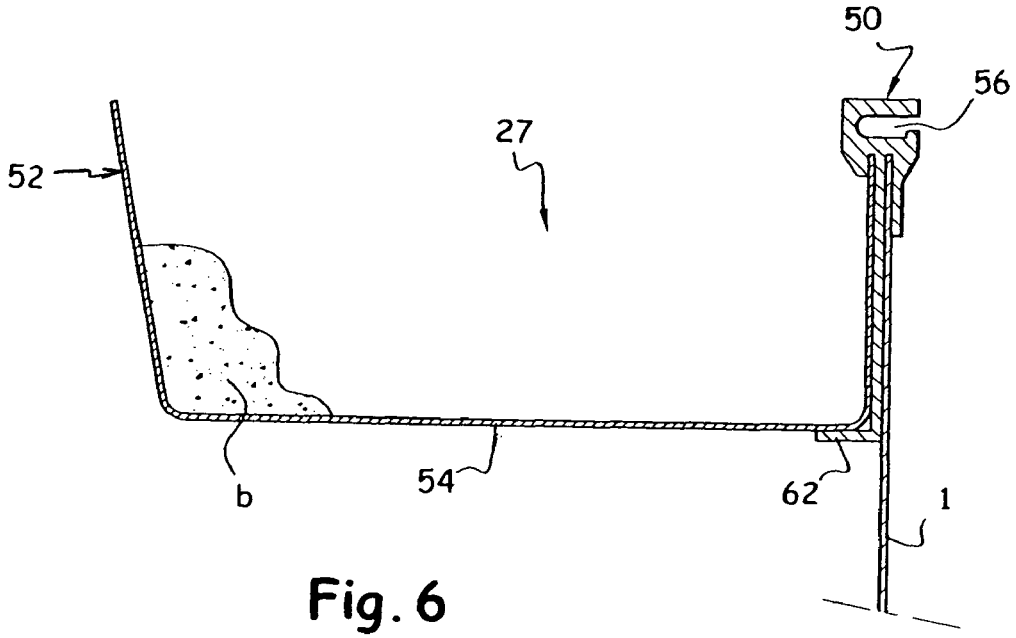

The high belt 27, which is shown diagrammatically in FIGS. 5 and 6, comprises both a set of strips 50 which are fitted to the panels 1 and a set of channel section members 52, each forming a gutter 54. Each strip 50 and each associated section member 52 extends over a length that is not less than that of a panel 1.

Each strip 50 presents a side groove 56 in which the liner of the swimming pool is secured. Each strip 50 presents a double wall defining a slot 60 in which the top portion of the panels 1 is received. The bottom portion of each strip 50 presents a rim 62 extending at substantially 90° which serves as a bearing surface for the gutter 54 of a section member 52, with a top edge of the gutter 54 engaging in a slot 64 in the strip 50. The way in which a gutter 54 is engaged in the associated strip 50 is shown in FIGS. 5 and 6, with this assembly operation being performed by mutual engagement so as to avoid any need to have recourse to additional fastener means.

Figure 7:
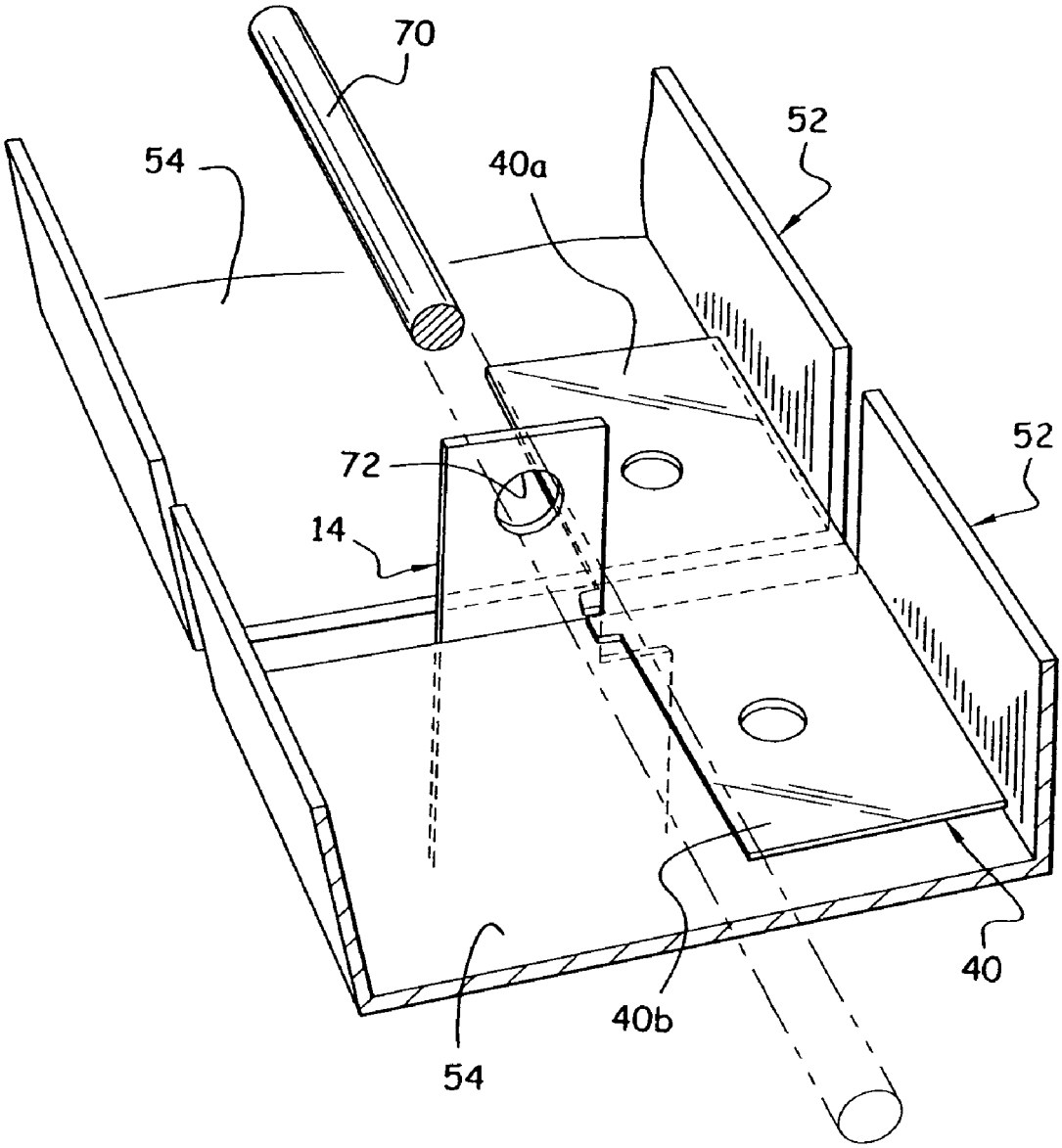
FIG. 7 is a fragmentary perspective view to show a portion only of the high belt of the wall.
Figure 8:
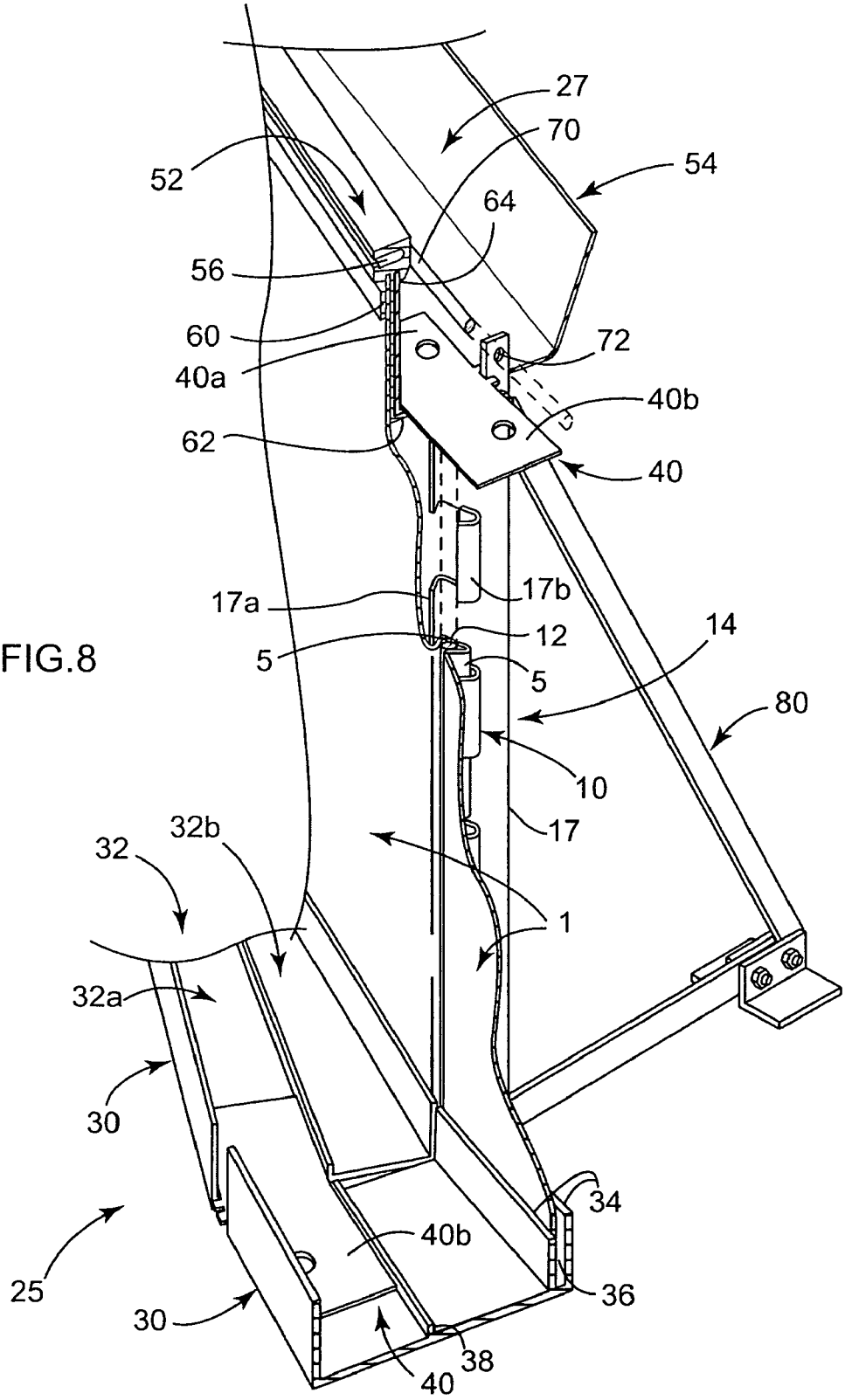
FIG. 8 is a perspective view of a wall in accordance with the invention.

Angle-determining means 40 similar to those of the low belt 25 are positioned in the bottoms of two adjacent gutters 54 of two consecutive panels 1 in order to define a curved portion. In the example shown in FIG. 7, the angle-determining means 40 has its two arms 40*a* and 40*b* extending each other, i.e. the angle being determined is 180°, and the two consecutive panels 1 are thus in alignment with each other. Under such circumstances, the angle-determining means are constituted merely by a rectilinear stiffening element. However, when the two consecutive panels 1 are not in alignment with each other, then two angle-determining means 40 are installed facing each other in the two adjacent gutters 32 of the low belt 25 and in two adjacent gutters 54 of the high belt 27, respectively.

Once all of the panels 1 have been assembled to one another in order to build up a shape of rectilinear and/or curved outline, the shape is "frozen" or stiffened by reinforcing means which are fixed rigidly to the low and high belts 25 and 27. More precisely, the low and high belts 25 and 27 of the swimming pool wall are connected to one another via the second section members 14 of the means 10 for assembling together two successive panels 1, the two ends of each second section member 14 of the assembly means 10 projecting respectively between two adjacent gutters 32 of the low belt 25 and between two adjacent gutters 54 of the high belt 27. Thereafter, reinforcing means are put into place, being constituted, for example, by concrete b which is cast in the gutters 32 and 54 of the low and high belts 25 and 27. Advantageously, the reinforcing means comprises metal reinforcement 70 inside the gutters of the high belt 27, this reinforcement 70 possibly being in the form of a metal rod which goes round the high belt 27, passing through an opening 72 pierced in the top portion of each of the second section members 14 of the assembly means 10. The concrete thus provides a rigid connection between the high and low belts 25 and 27 via the second section members 14.

With reference again to FIG. 3, each of the second section members 14 of the assembly means 10 may be fitted with a reinforcing strut 80 which is fixed to both ends of each section member 14.

The wall is assembled in two main stages. The first stage consists in assembling the panels to one another so as to obtain the shape of the rectilinear and/or curved outline of the wall. The second stage consists in stiffening this shape by casting concrete into the low and high belts of the above-described example.

Thus, the swimming pool wall is advantageously made from panels that are equally suitable for being mounted in a rectilinear portion or in a curved portion of the outline of the wall, there being no need for curved panels in order to make curved portions.

In a variant of the embodiment described above, the second section member 14 of the assembly means 10 can be made as two parts which are fitted one against the other, and then fixed together by any suitable means. The reinforcing means of the low and high belts 25 and 27 may be made by means other than concrete which has been given purely by way of example.

Furthermore, in the rectilinear portions of the wall, it is possible to use section members 30 for the low belt 25 that extend over a length that is greater than that of a panel 1 so as to be capable of supporting a plurality of panels. The same can apply to the strips 50 and the associated section members of the high belt 27.

In general, the panels 1 are advantageously made of sheet metal having a thickness of the order of 1.5 mm to 2 mm, but it would also be possible to use some other material, e.g. of the plastics type.

Finally, each panel 1 may be made in the form of a box section having respective inner and outer sheets that are parallel to each other and that are assembled together by means of a high belt and a low belt. Using box section panels makes it possible to use the panels to house equipment of the kind needed for operating and maintaining a swimming pool, such as a pump, filters, . . . .

What is claimed is:

1. A liquid-retaining wall comprising two consecutive vertically disposed prefabricated panels, assembly means for assembling together said two consecutive panels, a low belt on one side of said panels, which supports the panels and which comprises two consecutive low section members, and a high belt on an opposite side of said panels, which is fitted to the panels and which comprises two consecutive high section members substantially in the form of channel section gutters, the assembly means holding together said two consecutive panels while allowing one of them to move angularly relative to the other about a vertical axis, an angle-determining element for ensuring that said two consecutive panels are at a determined angular orientation relative to each other as a function of the outline of the wall to be made, and further including reinforcing means for stiffening said two consecutive panels once they have been assembled to one another, wherein said panels are planar and are equally suitable for including in a rectilinear or a curved portion of the outline of the wall, and wherein said angle-determining element comprises a plane part presenting two horizontal arms that are respectively mounted on two consecutive section members of the low belt and/or of the high belt and that form a determined angle relative to each other to shape the angle between said two consecutive panels.

2. A liquid retaining wall according to claim 1, wherein said panels are identical.

3. A liquid retaining wall according to claim 1, including means for leveling the heights of said panels.

4. A liquid retaining wall according to claim 1, wherein the low and high belts of the system are rigidly connected to each other by a portion of the assembly means.

5. A liquid retaining wall according to claim 1, wherein each section member extends over a length that is at least as long as the length of a panel supported thereby.

6. A liquid retaining wall according to claim 5, wherein each section member of the low belt is rectilinear and forms a substantially channel section gutter with a double wall extending along one of its longitudinal sides to define a slot in which the bottom portion of at least one panel is engaged.

7. A liquid retaining wall according to claim 6, wherein said angle-determining element is mounted in two consecutive gutters formed by two respective consecutive section members of the low belt.

8. A liquid retaining wall according to claim 6, wherein each section member of the low belt is stiffened by said reinforcing means.

9. A liquid retaining wall according to claim 8, wherein the reinforcing means are constituted by concrete which is cast into the gutter formed by each of the section members of the low belt.

10. A liquid retaining wall according to claim 8 wherein said reinforcing means comprises metal reinforcement.

11. A liquid retaining wall according to claim 1, wherein the high belt which is fitted to the panels is constituted by a set of strips and by said two consecutive high section members fixed respectively to the strips, each strip and each section member extending over a length that is at least as long as the length of a panel on which they are fitted.

12. A liquid retaining wall according to claim 11, wherein each section member associated with a strip is fixed by being engaged in said strip.

13. A liquid retaining wall according to claim 12, wherein said angle-determining element is mounted in two consecutive gutters respectively formed by two consecutive high section members of the high belt.

14. A liquid retaining wall according to claim 13, wherein each high section member of the high belt is stiffened by reinforcing means.

15. A liquid retaining wall according to claim 14, wherein the reinforcing means are constituted by concrete which is cast into the gutter formed by each high section member of the high belt.

16. A liquid retaining wall according to claim 14 wherein said reinforcing means comprises metal reinforcement.

17. A liquid retaining wall according to claim 1, wherein each panel mounted in a vertical position presents two vertical lateral edges, each lateral edge presenting over all or part of its height a folded flange, the two flanges of a panel being folded towards the same side of the panel, and wherein the assembly means between two consecutive panels comprise at least an internal, first section member mounted between the two adjacent flanges of said panels, and at least an external, second section member fitted over the two adjacent flanges of said panels and which penetrate into the insides of the low and high belts in such a manner that one of said panels is free to move angularly relative to the other of said panels about said vertical axis.

18. A liquid retaining wall according to claim 17, including leveling means for leveling the heights of two consecutive panels.

19. A liquid retaining wall according to claim 18, wherein the leveling means are constituted by a pin which is engaged in two holes pierced in the bottom portions of the flanges of the panels.

20. A liquid retaining wall according to claim 1, wherein each panel is made from a metal sheet that is about 1.5 mm to 2 mm thick.

21. A liquid-retaining wall according to claim 1 comprising a swimming pool wall.

* * * * *